US006472625B1

(12) United States Patent
Powell

(10) Patent No.: US 6,472,625 B1
(45) Date of Patent: Oct. 29, 2002

(54) PIEZO CERAMIC OPERATED MECHANISM

(75) Inventor: Simon Powell, Baldock (GB)

(73) Assignee: PBT ( IP) Limited, Harlow (GB)

( * ) Notice: Subject to any disclaimer, the term of this patent is extended or adjusted under 35 U.S.C. 154(b) by 0 days.

(21) Appl. No.: 09/701,113

(22) PCT Filed: May 26, 1999

(86) PCT No.: PCT/GB99/01645

§ 371 (c)(1),
(2), (4) Date: Dec. 18, 2000

(87) PCT Pub. No.: WO99/62090

PCT Pub. Date: Dec. 2, 1999

(30) Foreign Application Priority Data

May 26, 1998 (GB) ..... 9811277

(51) Int. Cl.[7] ..... H01H 9/20

(52) U.S. Cl. ..... 200/318; 200/181; 310/328; 310/330

(58) Field of Search ..... 200/181, 318, 200/321–327; 310/328, 330–332

(56) References Cited

U.S. PATENT DOCUMENTS 6,046,418 A * 4/2000 Feiler et al. ..... 200/508
6,323,581 B1 * 11/2001 Powell ..... 310/328

FOREIGN PATENT DOCUMENTS

| | | | |
|---|---|---|---|
| DE | 44 43 520 A | 6/1996 | ..... H01H/83/14 |
| EP | 0 288 167 A | 10/1988 | ..... H01H/73/30 |
| EP | 0 325 501 A | 7/1989 | ..... H01H/91/50 |

* cited by examiner

*Primary Examiner*—Michael Friedhofer
(74) *Attorney, Agent, or Firm*—Rankin, Hill, Porter & Clark LLP

(57) ABSTRACT

An over-center clamping mechanism is disclosed having a pivot guide to guide the pivot of one of the link arm members of the mechanism which comprises a piezoelectric actuator. The actuator is arranged to withdraw the pivot guide from the plane of the action of the mechanism, thereby allowing the guided pivot free movement of the plane of action which has the effect of collapsing the mechanism when is a clamped state.

19 Claims, 4 Drawing Sheets

PIEZO CERAMIC OPERATED MECHANISM

TECHNICAL FIELD

The present invention relates to controlled mechanisms where at least one mode of control is exercised by a piezo ceramic device, More particularly, the present invention relates to an over-centre mechanism where a piezo-ceramic device is used to control the mechanism whereby to collapse the mechanism when locked.

BACKGROUND ART

The use of over-centre mechanisms is known as a means of applying high clamping forces to electrical contacts, valve faces and frictional holding devices. The geometry of over-centre clamping mechanisms is also known, wherein the linkages in the mechanism must pass from one mode in which they are free to rotate, past the centreline of the plane of action and into a mode where they are urged to rotate by the reaction in the plane of action but are stopped by some mechanical means.

In order to readily collapse the mechanism, the means of stopping rotation can be withdrawn or otherwise collapsed, allowing spring forces to push the system open. Alternatively, the mechanism can be pulled back to rotate in the direction in which it was originally set. These actions are readily achieved with solenoids or fluidic pistons. The magnitude of the force necessary to cause the mechanism to collapse is generally lower than that required to set the system.

Electro-strictive piezo ceramic actuators are also known for the operation of mechanical devices, having the benefit of high speed, compact size and low power. Piezo devices are made in two basic forms. One type of device relies upon the basic change in dimension of the material. The change is measured in low parts per thousand, so devices of this type are generally suited only for micro positioning or ultrasonic transduction.

The other type of device acts like a bimetallic strip where the ceramic is bonded to a thin strip of metal to create a bending action. Although these devices have more movement it is still generally less than 1 mm and the output force is very low. Both types of devices are available in multilayer forms which increase motion and reduce operating voltage.

In order for a piezo actuator to be used for the release of an over-centre mechanism suited to mass production it is necessary to combine higher force with higher displacement.

SUMMARY OF THE INVENTION

It is an object of the present invention to provide an over-centre mechanism in which a locked condition of the mechanism is released by an electrically actuable pivot guide releasing a pivot of a link of the mechanism by moving the pivot guide in a direction out of the plane of motion of the linkage, thereby allowing free motion of the pivot on the plane of motion and collapsing the mechanism.

In order to meet the above object according to the present invention there is provided an over-centre clamping mechanism comprising an actuating lever member arranged to rotate about a fixed pivot, a link arm member rotatably attached to said actuating lever member by a first movable pivot, and an actuable pivot guide means arranged to constrain the movement of a second movable pivot provided on said link arm member within a plane of action, wherein said actuable pivot guide means is electrically actuable to move out of said plane of action to release said second movable pivot whereby to collapse the clamping mechanism when said clamping mechanism is set.

The actuable pivot guide means may further comprise a piezo-ceramic bender actuator arranged to bend in a direction away from the plane of motion of the mechanism in order to allow the guide pivot to be released.

Furthermore, in a first mode of operation the guide means may constrain the guided pivot to move along a line on the plane of motion of the mechanism, and in a second mode of operation when the guide means have moved out of the plane of motion, the guided pivot may be free to move on the plane of motion.

The over-centre mechanism may further comprise a carrier arm arranged to rotate about a second fixed pivot point in response to the action of an action point of the link arm member there against, in order to force a free end of the carrier arm against a fixed portion in order to lock the mechanism.

The carrier arm and the fixed portion may each be provided with electrical contacts thereon, arranged to contact when the mechanism is locked.

Instead of being of single piece construction, the link arm member may comprise two link arms, one connected between the first movable pivot on the actuating lever member and the guided pivot, and the other connected between the guided pivot and a third pivot provided on the carrier arm member.

DESCRIPTION OF THE DRAWINGS

In order that the present invention be more readily understood embodiments thereof will now be described by way of example with reference to the accompanying drawings, in which.

DESCRIPTION OF THE PREFERRED EMBODIMENTS

In the following description, the mechanism is shown operating a set of contacts, but the same principles apply to releasing a gas valve, removing a clamping force, or in any other application where an over-centre mechanism is used and is required to be released quickly and automatically.

Figure 1A:
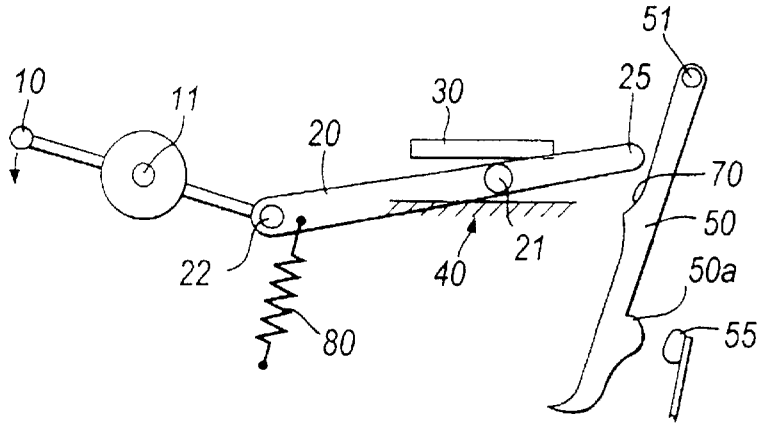
FIGS. 1*a*, 1*b* and 1*c* show a sequence of operation of a first embodiment of the present invention.
Figure 1B:
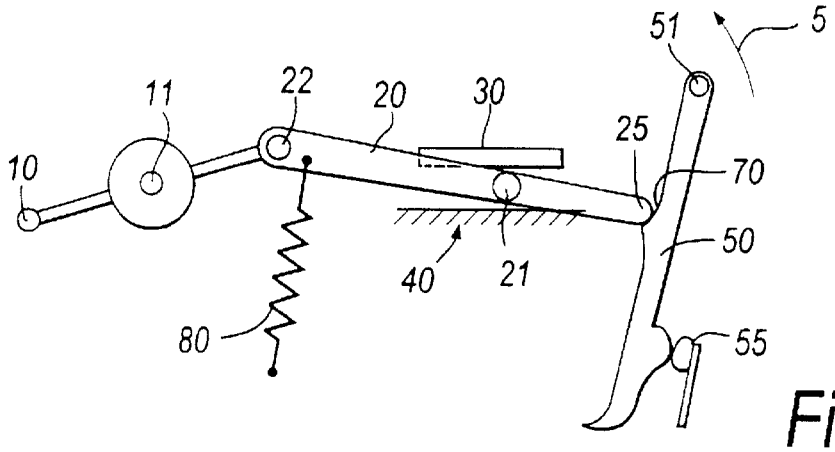
Figure 1C:
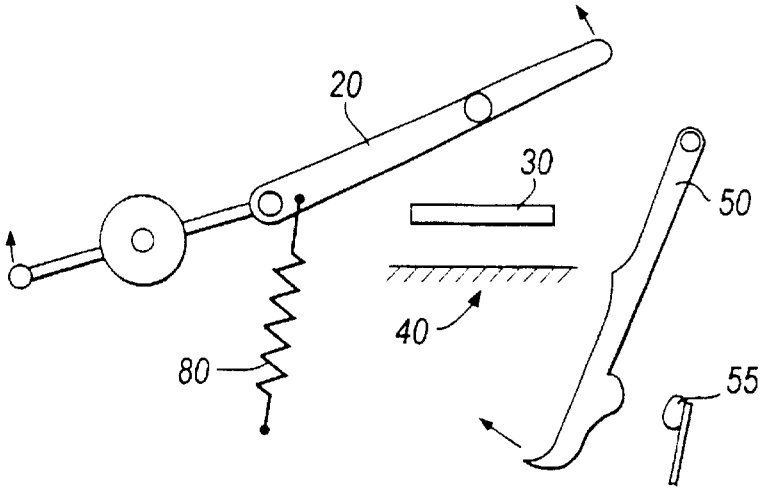

Referring to FIG. 1, an over-centre mechanism is provided in which main pivots 11 and 51 are fixedly mounted to a suitable backplane which is not shown. An actuating lever 10 is rotatably connected to the main pivot 11 and to a link arm 20 by means of another pivot 22. FIG. 1*a* shows the mechanism in its starting position.

Figure 5:
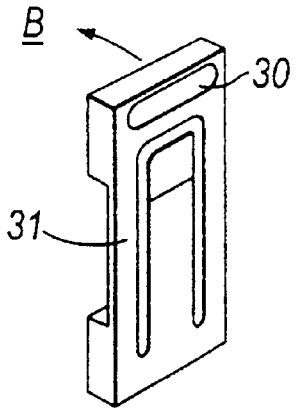
FIG. 5 shows a perspective diagrammatic view of a particular arrangement of the electrically actuable guide means used in the preferred embodiment of the present invention.

The link arm 20 is constrained to move in a straight line by guide pivot 21 on the arm 20 being received in a groove whose sides are formed by a fixed member 40 associated with the backplane, and by a feature 30 on a suitably shaped actuator 31. Rotation of the actuating lever 10 results in rotation and lateral movement of the link arm 20, with the mechanism being constructed such that the pivot 22 can be rotated to a small angle beyond the horizontal centreline through the fixed pivot 11. The output point, in this case is a rotatable contact carrier 50 pivotally mounted to the fixed pivot 51 and biassed to the "off" position. The moving contact carrier 50 is positioned to bear against the free end 25 of the link arm 20 so that it rotates about the fixed pivot 51 as the actuating lever 10 is operated. When the actuating lever is approaching the horizontal centreline, a contact 50*a* on the moving contact carrier 50 is brought into contact with a fixed contact 55 and pressure is applied to the arrangement as the mechanism moves to the horizontal and beyond. This situation is shown in FIG. 1*b*. The surface of the moving contact carrier 50 which is engaged by the link arm free end 25 has upon it an angled portion 70 which imparts a rotary moment to the link arm 20 in the direction of the arrow 5 in FIG. 1*b*. This rotary moment causes the link arm guide pivot 21 to bear against the upper wall of the constraining groove, which is formed by the feature 30 on an electrically actuable actuator 31, such as a piezoelectric actuator. A particular arrangement of a suitable piezo electric actuator is shown in FIG. 5, wherein the feature 30 is in the form of a groove cut or otherwise formed at or near to one end of the actuator plate 31. The actuator plate 31 is made from piezo-ceramic material arranged to bend in the direction of the arrow B in response to a suitable electric signal. Although here the feature 30 is shown as a groove, the feature 30 may also be any other shape which acts as a pivot guide, such as, for example, an extended platform formed on the plate 31.

Figure 2:
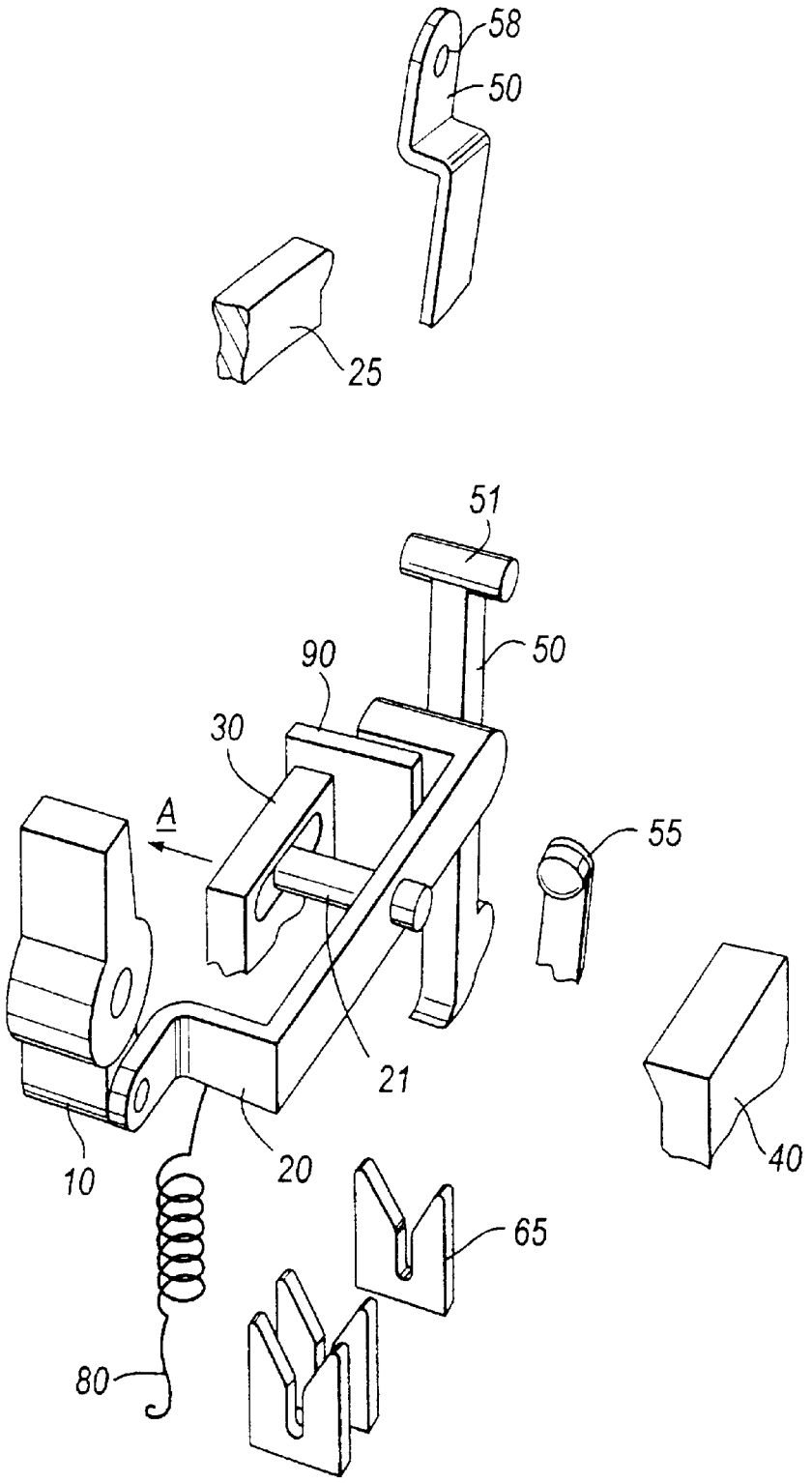
FIG. 2 shows a perspective diagrammatic view of how to implement the embodiment shown in FIG. 1.

The mechanism is collapsed by the feature 30 moving in the direction of the arrow A on FIG. 2. This is equivalent to the actuator moving into the plane of the paper in FIG. 1. The length of the guide pivot 21 is such that the motion of the feature 30 causes it to be freed from the constraint of the feature. This freedom permits the guide pivot 21 to move upwards under the action of the return force on the contact carrier 50 until the guide pivot 21 rises above the level of the pivot 22 whereupon a return spring 80 connected to the link arm 20 causes the rotary moment 5 to be exerted upon the link arm 20 and for the link arm to rotate around the link pivot 22. The moving contact carrier 50 is constructed such that upwards movement of the link arm 20 causes the two parts to disengage such that the moving contact 51 can return to its starting position under the power of a suitable spring which is not shown. The contacts will still open if the actuating lever is prevented from returning to its starting position and the speed of the opening is independent of the speed of the linkages.

The mechanism is reset by virtue of spring 80 which pulls the link and actuating lever down until the link arm guide pivot 21 is restored to within the constraint of the feature 30 once the piezo actuator has returned to its original position.

Control of high fault currents is achieved through the use of conveniently shaped and located arc splitter plates 65 as shown in FIG. 2 or other suitable devices, such as series positioned positive temperature co-efficient resistors.

Figure 3A:
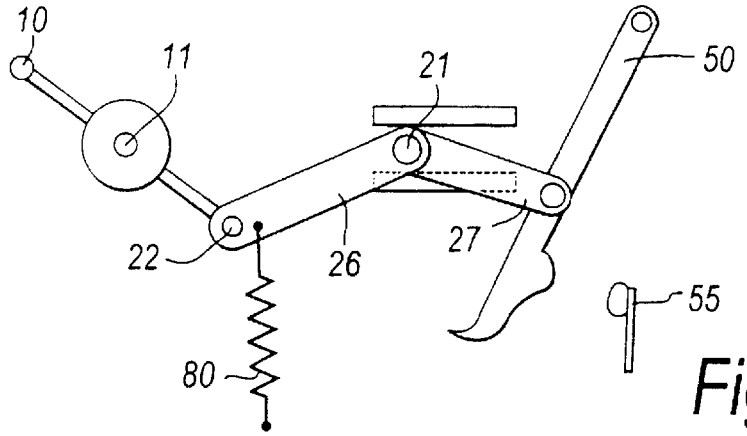
FIGS. 3*a*, 3*b* and 3*c* show a sequence of operation of a modification to the first embodiment shown in FIG. 1.
Figure 3B:
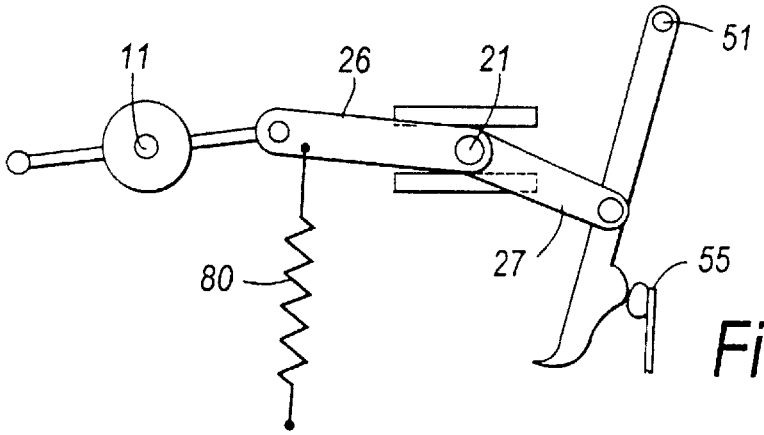
Figure 3C:
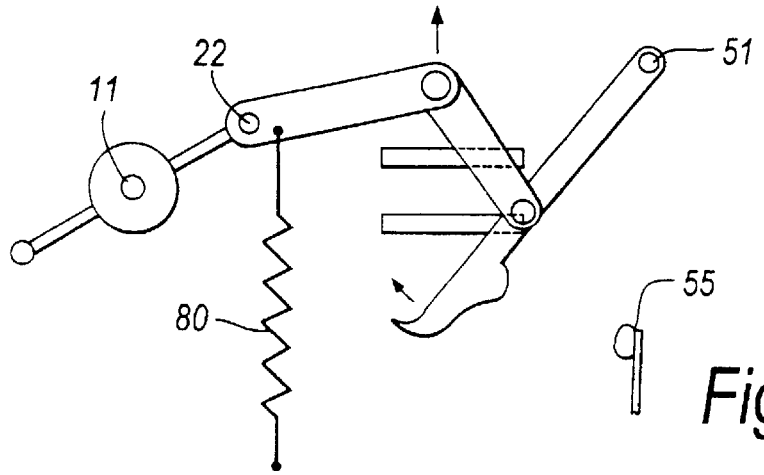

FIGS. 3*a* to 3*c* show a modification in which the link arm 20 is replaced by two link arms 26, 27 which are pivotally linked at the guide pivot 21 and in which the second pivot 27 is pivotally linked to the moving contact carrier 50. The motion of the setting lever 10 forces the first link 26 along the groove created by the backplane and the feature 30 of the piezo as before, which in turn causes the second link 27 to act upon the moving contact causing it to rotate with respect to its pivot 51. The angle of the second link is constrained to always be below the horizontal centreline of the constraining groove, but a spring force is provided for urging the two link arms 26, 27 apart so that there is always a force trying to push the pivot 21 of the linkage upwards.

The first pivot point 22 passes beyond the centrelne of the actuating lever centre 11 and so is locked. Release is achieved by allowing the guide pivot 21 to move upwards which is done by the motion of the piezo actuator 30 as described earlier. This design is more robust because the moving parts are permanently linked, but there is a higher component count.

Figure 4:
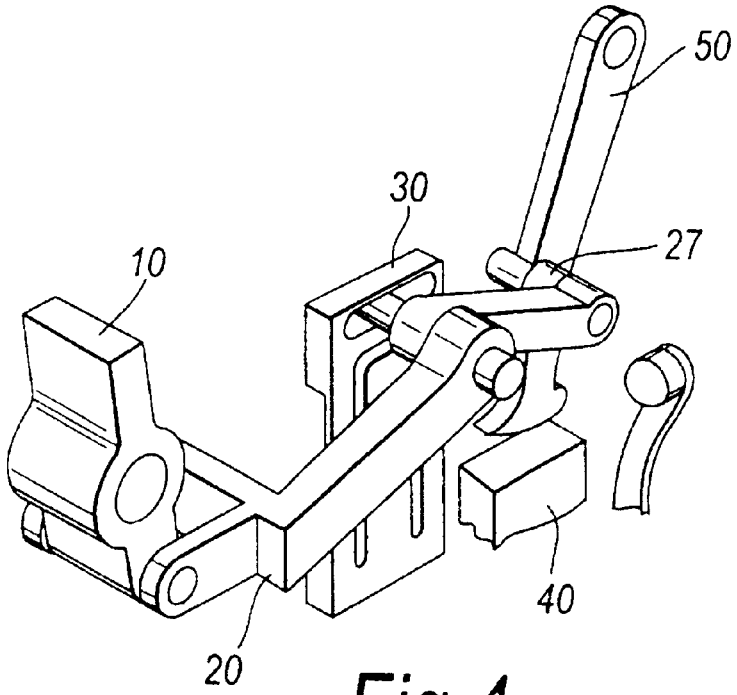
FIG. 4 shows a perspective diagrammatic view of how to implement the modified embodiment.

FIG. 4 shows a 3D sketch view of the overall arrangement with the two linkages.

As is apparent from FIGS. 2 and 4, the groove formed by the feature 30 in the piezo device 31 and the feature 40 associated with the backplane need not both be on the same side of the mechanism; one feature can be on one side with the other feature on the other side.

What is claimed is:

1. An over-center clamping mechanism comprising an actuating lever member arranged to rotate about a fixed pivot, a link arm member rotatably attached to said actuating lever member by a first moveable pivot, and an actuable pivot guide means arranged to constrain the movement of a second moveable pivot provided on said link arm member within a plane of action, wherein said actuable pivot guide means is electrically actuable to collapse the clamping mechanism when said clamping mechanism is set; and wherein said actuable pivot guide means comprises a linear piezo-ceramic bender actuator arranged to bend in a direction transverse to the plane of action to release said second moveable pivot.

2. An over-center clamping mechanism according to claim 1, wherein said actuable pivot guide means constrains said second movable pivot to move along a line on said plane of action in a first mode of operation, and moves out of said plane of action to allow said second movable pivot to move freely on said plane of action in a second mode of operation.

3. An over-center clamping mechanism according to claim 2, and further comprising a carrier arm member arranged to rotate about a second fixed pivot in response to an action point of said link arm member acting thereon in response to actuation of said actuating lever member, whereby to force a free end of said carrier arm member against a fixed portion in order to set said clamping mechanism.

4. An over-center clamping mechanism according to claim 3, wherein said free end of said carrier arm and said fixed portion are each provided with an electrical contact arranged in opposite relation to each other whereby to contact when said clamping mechanism is set.

5. An over-center clamping mechanism according to claim 1, and further comprising a carrier arm member arranged to rotate about a second fixed pivot in response to an action point of said link armmember acting thereon in response to actuation of said actuating lever member, whereby to force a free end of said carrier arm member against a fixed portion in order to set said clamping mechanism.

6. An over-centre clamping mechanism according to claim 5, wherein said free end of said carrier arm and said fixed portion are each provided with an electrical contact arranged in opposite relation to each other whereby to contact when said clamping mechanism is set.

7. An over-center clamping mechanism according to claim 5, wherein said carrier arm member is further provided with an angled portion arranged to rceive the action point of said link arm there against, and further arranged to exert a turning point force thereon.

8. An over-center clamping mechanism according to claim 5, wherein said link arm member comprises a first link arm arranged to link said first movable pivot and said second movable pivot, and a second link arm arranged to link said second movable pivot and a third movable pivot provided on said carrier arm member.

9. An over-center clamping mechanism according to claim 1, wherein said actuable pivot guide means constrains said second movable pivot to move along a line on said plane of action in a first mode of operation, and moves out of said plane of action to allow said second moveable pivot to move freely on said plane of action in a second mode of operation.

10. An over-center clamping mechanism according to claim 9, and further comprising a carrier arm member arranged to rotate about a second fixed pivot in response to an action point of said link arm member acting thereon in response to actuation of said actuating lever member, whereby to force a free end of said carrier arm member against a fixed portion in order to set said clamping mechanism.

11. An over-center clamping mechanism according to claim 10, wherein said free end of said carrier arm and said fixed portion are each provided with an electrical contact arranged in opposite relation to each other whereby to contact when said clamping mechanism is set.

12. An over-center clamping mechanism according to claim 11, wherein said carrier arm member is further provided with an angled portion arranged to receive the action point of said link arm thereagainst, and further arranged to exert a turning force thereon.

13. An over-center clamping mechanism according to claim 11, wherein said link arm member comprises a first link arm arranged to link said first movable pivot and said second movable pivot, and a second link arm arranged to link said second movable pivot and a third movable pivot provided on said carrier arm member.

14. An over-center clamping mechanism according to claim 1, and further comprising a carrier arm member arranged to rotate about a second fixed pivot in response to an action point of said link arm member acting thereon in response to actuation of said actuating lever member, whereby to force a free end of said carrier arm member against a fixed portion in order to set said clamping mechanism.

15. An over-center clamping mechanism according to claim 14, wherein said free end of said carrier arm and said fixed portion are each provided with an electrical contact arranged in opposite relation to each other whereby to contact when said clamping mechanism is set.

16. An over-center clamping mechanism according to claim 15, wherein said carrier arm member is further provided with an angled portion arranged to receive the action point of said link arm thereagainst, and further arranged to exert a turning force thereon.

17. An over-center clamping mechanism according to claim 15, wherein said link arm member comprises a first link arm arranged to link said first movable pivot and said second movable pivot, and a second link arm arranged to link said second movable pivot and a third movable pivot provided on said carrier arm member.

18. An over-center clamping mechanism according to claim 14, wherein said carrier arm member is further provided with an angled portion arranged to receive the action point of said link arm thereagainst, and further arranged to exert a turning force thereon.

19. An over-center clamping mechanism according to claim 14, wherein said link arm member comprises a first link arm arranged to link said first movable pivot and said second movable pivot, and a second link arm arranged to link said second movable pivot and a third movable pivot provided on said carrier arm member.

* * * * *